US011111697B2

(12) United States Patent
Overgaard

(10) Patent No.: US 11,111,697 B2
(45) Date of Patent: Sep. 7, 2021

(54) ELECTROMECHANICAL DOOR LOCK ACTUATION DEVICE AND METHOD FOR OPERATING IT

(71) Applicant: Danalock ApS, Harlev J (DK)

(72) Inventor: Henning Overgaard, Harlev J (DK)

(73) Assignee: DANALOCK APS, Harlev (DK)

( * ) Notice: Subject to any disclaimer, the term of this patent is extended or adjusted under 35 U.S.C. 154(b) by 510 days.

(21) Appl. No.: 16/064,097

(22) PCT Filed: Dec. 27, 2016

(86) PCT No.: PCT/DK2016/050470
§ 371 (c)(1),
(2) Date: Jun. 20, 2018

(87) PCT Pub. No.: WO2017/114534
PCT Pub. Date: Jul. 6, 2017

(65) Prior Publication Data

US 2019/0010731 A1 Jan. 10, 2019

Related U.S. Application Data

(60) Provisional application No. 62/272,160, filed on Dec. 29, 2015.

(30) Foreign Application Priority Data

Dec. 29, 2015 (DK) ..... PA 2015 70886

(51) Int. Cl.
*E05B 47/02* (2006.01)
*E05B 47/00* (2006.01)
(Continued)

(52) U.S. Cl.
CPC ..... *E05B 47/026* (2013.01); *E05B 47/0012* (2013.01); *E05B 47/0002* (2013.01);
(Continued)

(58) Field of Classification Search
CPC ..... E05B 47/026; E05B 47/0012; E05B 47/0002; E05B 2009/046; E05B 2009/042;
(Continued)

(56) References Cited

U.S. PATENT DOCUMENTS 3,917,330 A * 11/1975 Quantz ..... E05B 81/14 292/216
4,573,723 A 3/1986 Morita et al.
(Continued)

FOREIGN PATENT DOCUMENTS

CN 101608515 A 12/2009
CN 102182357 A 9/2011
(Continued)

OTHER PUBLICATIONS

Supplementary European Search Report dated Apr. 11, 2019 for Application No. 16 88 1306.
(Continued)

*Primary Examiner* — Kristina R Fulton
*Assistant Examiner* — Steven A Tullia
(74) *Attorney, Agent, or Firm* — Schmeiser, Olsen & Watts, LLP

(57) ABSTRACT

A door lock actuation device configured for operating a door lock in a door blade, wherein the door lock includes a dead bolt driven by rotation of a connector is provided. The device includes a casing, inside which there is provided a motor for driving a rotational connector-receiver that receives and rotates the connector. The device also includes a rotational handle mechanically connected to the connector-receiver, for forcing rotation of the connector-receiver by manual rotation of the handle. The motor is selectively
(Continued)

disconnectable from the connector-receiver for manual driving of the connector-receiver by the handle without back-driving the motor.

8 Claims, 5 Drawing Sheets

(51) Int. Cl.
*E05B 9/04* (2006.01)
*E05B 15/04* (2006.01)

(52) U.S. Cl.
CPC ... *E05B 2009/046* (2013.01); *E05B 2015/042* (2013.01); *E05B 2047/002* (2013.01); *E05B 2047/0022* (2013.01); *E05B 2047/0026* (2013.01); *E05B 2047/0091* (2013.01)

(58) Field of Classification Search
CPC ..... E05B 2015/042; E05B 2015/002; E05B 2047/002; E05B 2047/0022; E05B 2047/0026; E05B 2047/0091; Y10T 292/307; Y10T 292/308
USPC .... 292/201; 70/190, 191, 277, 278.7, 279.1, 70/280, 282
See application file for complete search history.

(56) References Cited

U.S. PATENT DOCUMENTS 5,148,691 A * 9/1992 Wallden ..... E05B 47/0012 70/279.1
5,441,315 A 8/1995 Kleefeldt et al.
6,474,704 B1 * 11/2002 Rathmann ..... E05B 81/14 292/201
6,609,736 B2 * 8/2003 Yeh ..... E05B 47/0012 292/144
7,520,152 B2 * 4/2009 Sabo ..... E05B 63/18 292/144
7,671,719 B2 * 3/2010 Sogo ..... G06F 21/31 340/5.73
8,272,240 B1 * 9/2012 Schilens ..... E05C 3/042 70/208
9,097,037 B2 8/2015 Mckibben et al.
2002/0125724 A1 * 9/2002 Doong ..... E05B 47/0012 292/144
2003/0167808 A1 * 9/2003 Ugalde Blanco ..... E05B 47/026 70/257
2004/0245785 A1 * 12/2004 Chen ..... E05B 47/0012 292/144
2005/0127685 A1 * 6/2005 Spurr ..... E05B 81/64 292/201
2008/0307837 A1 * 12/2008 Greiner ..... E05B 63/0065 70/282
2012/0324967 A1 * 12/2012 Goren ..... E05B 47/0603 70/280
2013/0192317 A1 * 8/2013 McKibben ..... E05B 47/0012 70/278.1
2014/0265359 A1 * 9/2014 Cheng ..... E05B 47/026 292/144
2015/0096341 A1 4/2015 Overgaard
2015/0332527 A1 * 11/2015 Pukari ..... G07C 9/20 70/277

FOREIGN PATENT DOCUMENTS

DE 102004021704 B3 12/2005
EP 2782661 A1 8/2014
FR 2 693 757 A1 1/1994
FR 2849084 A1 6/2004
FR 2866051 A1 8/2005
GB 2448427 A * 10/2008 ..... E05B 47/0012
KR 20010084987 A * 9/2001 ..... E05B 47/0012
KR 101 467 984 B1 12/2014
WO 2004/059110 A1 7/2004
WO 2016/194304 A1 12/2016

OTHER PUBLICATIONS

International Search Report—PCT/DK2016/050470.
Written Opinion—PCT/DK2016/050470.
Danish Search Report dated Jul. 27, 2016 for Application PA 2015 70886.

* cited by examiner

ELECTROMECHANICAL DOOR LOCK ACTUATION DEVICE AND METHOD FOR OPERATING IT

CROSS-REFERENCE TO RELATED APPLICATIONS

This application claims priority to PCT Application No. PCT/DK2016/050470 having a filing date of Dec. 27, 2016, which is based on DK Application No. PA 2015 70886, having a filing date of Dec. 29, 2015, which is based on U.S. Ser. No. 62/272,160, having a filing date of Dec. 29, 2015, the entire contents all of which are hereby incorporated by reference.

FIELD OF TECHNOLOGY

The following relates to electromechanical door lock actuation devices with motor drive as well as manual drive. It also relates to a method for operating such device.

BACKGROUND

In order to facilitate opening and locking of door locks, various electromechanical door lock systems have been proposed.

FIG. 1 illustrates a known door lock actuator system 8. A door blade 1 comprises a straight spring latch handle 2 that actuates a spring latch 4 in a door lock 3. A dead bolt 5 is actuated by a lock cylinder 6 that has a key receiver (not shown) on one side of the door 1. The lock cylinder 6 has on its opposite end towards the door blade a connector 7, provided as a lock actuator pin, for connection to another lock element, for example a manual knob or an electromechanical actuator 8, as illustrated, which by rotation of the lock actuator pin 7 operates the dead bolt 5 between a fully retracted position, as illustrated, and a fully extended position, which is typically called a dead position. Such an electromechanical actuator is disclosed in US patent application No. 2015/0096341. The actuator is battery driven but also comprises a cylindrical handle 9 around the motorised actuator 8. Turning the cylindrical handle 9 manually actuates the dead bolt 5 and also rotates the motor. This rotation of the motor requires additional manual force in excess to the force that is required to move the dead bolt 5.

U.S. Pat. No. 9,097,037 discloses an electromechanical door lock of a similar principle with a key entry on one side of the door and a handle on the opposite side and with an electromechanical actuator inside a housing. However, between the handle and the electromechanical actuator, there is provided a so-called lost motion where the handle can rotate over an angular range of free motion for operating the dead bolt without driving the motor. In order to provide this free motion, a driver coupler, which is connected to the dead bolt, is freely movable inside a pocket between two shoulders on opposite ends of the pocket. When the motor is used for actuation, a gearwheel will rotate the pocket relatively to the driver coupler and move the shoulders towards the driver coupler and engage with it in order to electromechanically drive it by the shoulders.

In practice, in U.S. Pat. No. 9,097,037, the time between activation of the motor and the engagement of the shoulders with the driving couples takes several seconds, which for an impatient user appears as unacceptable long time. Another disadvantage is the fact that manual operation of the lock in case of power failure requires substantial manual force for backdriving the motor, which for elderly people and children is difficult.

It would be desirable to improve the system towards a quicker acting system and which requires less force for manual operation in case of power failure.

SUMMARY

An aspect relates to an electromechanical door lock actuation system with a manual handle in which the handle operation for moving the dead bolt does not drive the motor but is quickly acting on the dead bolt when switching from manual operation to electromechanical actuation. It is another aspect to provide an electromechanical door lock actuation system with a manual handle in which the manual handle can be used without driving the motor even in the case of power failure. These aspects are achieved with door lock actuation devices and their operation as explained in more detail in the following.

The door lock actuation device is configured for operating a door lock in a door blade, wherein the door lock comprises a dead bolt driven by rotation of a connector, typically a lock actuator pin, which is functionally connected to the dead bolt.

The device comprises a casing, inside which there is provided a rotational connector-receiver, for example pin-receiver, for receiving and rotating the connector, for example the lock actuator-pin, which connects to the lock for driving the dead bolt when the casing is mounted on the door blade. A motor is provided inside the casing for driving the connector-receiver, for example pin-receiver.

The device comprises a rotational handle mechanically connected to the connector-receiver, for forcing rotation of the connector-receiver by manual rotation of the handle.

The connector-receiver comprises a receiver-gearwheel such that rotation of the receiver-gearwheel in opposite directions causes rotation of the connector-receiver in opposite directions. The motor is coupled to a first gearwheel for being driven by torque from the motor. The first gearwheel is connectable to the receiver-gearwheel by intermeshing for conveying torque from the motor to the receiver-gearwheel via the first gearwheel. However, in addition, the first gearwheel is also disconnectable from the receiver-gearwheel for breaking the intermeshing torque connection between the receiver-gearwheel and the motor. As the device has the possibility to connect and disconnect the motor from the connector-receiver, a selective motorised or manual driving of the pin-receiver is possible without the manual driving by the handle affecting the motor. This is in contrast to many prior art systems, where manual driving of the dead bolt requires force to also backdrive the motor.

Optionally, for the intermeshing between the first gearwheel and the receiver-gearwheel, there is provided a gearwheel system with a plurality of gearwheels in intermeshing configuration.

In a practical embodiment, the gearwheel system comprises a bridge extending from a stationary gearwheel axle with a stationary motor-driven gearwheel to a swingable gearwheel axle with a swingable gearwheel, where the two gearwheels are intermeshed. The swingable gearwheel axle is carried by the bridge. Thus, upon motorised activation, the bridge is swinging the swingable gearwheel about the stationary gearwheel axle between a first and a second angular position. The first angular position of the bridge implies intermeshing of the swingable gearwheel with the receiver-gearwheel at one location of the receiver-gearwheel for driving the receiver-gearwheel in a first rotational direction by the swingable gearwheel. The second angular position of the bridge implies intermeshing of the rotational swingable gearwheel with the receiver-gearwheel at another location of the receiver-gearwheel for driving the receiver-gearwheel in a second, opposite rotational direction by the swingable gearwheel. The switch between the first and second angular position is very quickly as compared to the actuation of the connector, especially, if the swingable gearwheel is smaller than the receiver-gearwheel.

For example, the bridge is connected to the stationary rotational gearwheel through a friction clutch for swinging the bridge by rotation of the stationary motor-driven gearwheel, unless the rotation of the bridge is blocked by the instance of the swingable gearwheel abutting the receiver-gearwheel at the first or second rotational position, in which case the friction clutch allows frictional movement between the stationary rotational gearwheel and the bridge.

Typically, the bridge is configured for rotation over a range of more than 180 degrees between the first and second angular position, for example in the range of 180 to 270 degrees.

Advantageously, the rotation of the bridge from the first to the second position is caused by rotation of the motor in one direction and the rotation of the bridge from the second to the first position is caused by rotation of the motor in the opposite direction.

Optionally, the system comprising an electronic decoder configured for measuring the angular movement of the connector-receiver, and being configured for stopping the motor and the rotation of the connector-receiver at a predetermined dead bolt extension position and predetermined retraction position. For example, the decoder is functionally connected to a toothed decoder wheel intermeshed with the gearwheel system or with the receiver-gearwheel, where the rotation of the decoder wheel is read by the decoder. Optionally, the electronic decoder is configured for reversing the motor, as a consequence of stopping the motor, for driving the first gearwheel in an opposite direction over an angle that is less than the angular distance between the first and the second angular position. This driving of the opposite direction disconnects the motor from the connector-receiver by separating the bridge from the receiver-gearwheel and allows for unhindered manual rotation of the connector-receiver while disconnected from the motor.

For example, the door lock actuation device is operated as follows. The first gearwheel is connected to the receiver-gearwheel, for example through a gear wheel system as explained above, and motorised actuation of the dead bolt is activated by conveying torque from the motor to the receiver-gearwheel via the first gearwheel, optionally via the gear wheel system. Then, the first gearwheel, or gearwheel system, is disconnected from the receiver-gearwheel for breaking the intermeshing torque connection between the receiver-gearwheel and the motor for allowing manual driving of the connector-receiver without the manual action backdriving the motor.

It is pointed out that such system is useful not only for the gearwheel system comprising pinion gears but can also be used for worm-gears, which are self-locking such that manual backdriving of the motor is not possible. As the connection to the motor is broken, no force is exerted backwards through the gearwheel system towards the motor, which would otherwise affect such a worm gear. Thus, the automatic motorised backwards motion of the bridge to get the receiver-gearwheel out of engagement, solves the problem encountered when worm-gears are part of the gearing system between the motor and the dead bolt.

Such system for unhindered manual rotation works well as long as there is electrical power available for the decoder and the motor for the backwards motion of the bridge.

However, in case that there is a power failure, for example batteries running out of power or an electrical failure, the bridge may happen to stay in the first or second position in engagement with the receiver-gearwheel. In order to safeguard an unhindered manual operation also in this situation, even when self-locking worm-gears are involved, the following embodiments are useful. Accordingly, a resilient spring mechanism is provided at the first and at the second position, the spring mechanism acting against the force of the bridge against the receiver-gearwheel and separating the swingable gearwheel from engagement with the receiver-gearwheel. For example, the resilient spring mechanism comprises a resilient part and an abutment. Optionally, the resilient part is part of a spring member and extends from the bridge and is configured for swinging together with the bridge against the abutment, which is provided remotely from the bridge.

When the bridge is swung for intermeshing the teeth of the receiver-gearwheel and the resilient part of the spring member abuts the abutment and is resiliently deformed against the abutment due to the pressing force of the bridge towards the receiver-gearwheel due to the friction clutch, which provides force enough to deform the resilient part of the spring member and to keep the swingable gearwheel in tooth-engagement with the receiver-gearwheel. Once, the rotation stops, the force on the resilient part stops as well, and the resilient part returns to the original shape, pressing the bridge away from the abutment and, thereby, the swingable gearwheel away from the receiver-gearwheel and out of the engagement with the receiver-gearwheel.

In some embodiments, the device comprises a first and a second abutment separate from the gearwheel system, the first abutment being provided for interaction with the resilient part at the first angular position, and the second abutment being provided for interaction with the resilient part at the second angular position.

Alternatively, the resilient spring mechanism is provided as a resilient stationary spring member separate from the swingable bridge in combination with an abutment that is swinging together with the bridge against the resilient stationary spring member. As an alternative, a magnet system with at least one magnet is provided and arranged for providing magnetic force acting on the bridge for disengaging the swingable gearwheel from the intermeshing with the receiver-gearwheel.

For example, the magnet system comprises at least one electromagnet configured for electrical activation to provide the magnetic force acting on the bridge. For example, there are provided two electromagnets on opposite sides of the bridge.

For example, two magnets are arranged on opposite sides of a line connecting the centre of the receiver-gearwheel with the centre of the stationary gearwheel axle. For example, the two magnets are arranged symmetrically on opposite sides of the line.

Alternatively, the magnet system comprises one or more permanent magnets that exert a force on the bridge against the force from the friction clutch. As long as the motor is active and through the friction clutch presses the swingable gearwheel into engagement with the receiver-gearwheel, the force of the magnet or magnets is not strong enough to disengage the swingable gearwheel from the receiver-gearwheel. The friction clutch and the magnet or magnets is adjusted such that the force on the bridge from the friction clutch is higher than the counteracting force from the at least one magnet. However, once the motor stops, the magnetic force is strong enough to cause a minute displacement, sufficient for disengagement of the swingable gearwheel from the receiver-gearwheel.

The motor of the device can in principle be activated by power from a power source that is started by manually pushing a push button contact that closes an electrical circuit. Instead of the push button contact, an electrical relay switch can be used, for example operated automatically. Alternatively or in addition, the motor is activated by turning of the handle; a decoder reads the turning of the connector receiver by the manually rotational handle, which activates the motor in order to assist the user in locking or unlocking the door.

As a further option, the device is operated remotely by a wireless signal. For example, the device comprises a receiver inside the casing for receiving and executing wireless digital command data for locking or unlocking the door lock, the receiver being functionally coupled to the motor for activating the motor in dependence of the locking or unlocking command.

For example, the receiver is configured for wireless digital command signals, for example Bluetooth, WIFI, Z-wave, ZigBee, or radio frequency signals. An integrated circuit inside the casing is configured and programmed for activating the motor in either direction upon receiving a corresponding wireless command signal by the receiver, for example from a smartphone or pager. The device will, typically, comprise a transceiver for bidirectional digital communication with a programmable computer system for controlling the device remotely, for example by a smartphone or other type of computer, optionally with encrypted digital communication. The latter can be achieved with corresponding encryption keys communicated between the integrated circuit and the smartphone or other type of computer that is used for remotely operating the device.

BRIEF DESCRIPTION

Some of the embodiments will be described in detail, with references to the following figures, wherein like designations denote like members, wherein.

Figure 3A:
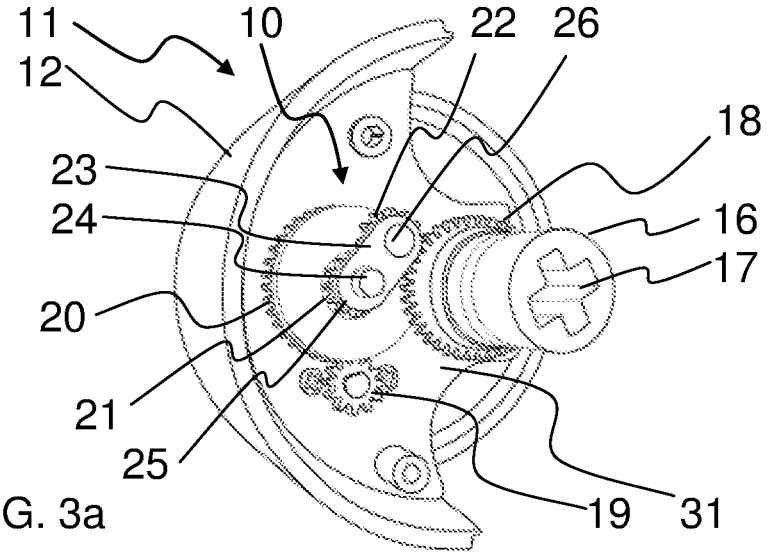
Figure 3B:
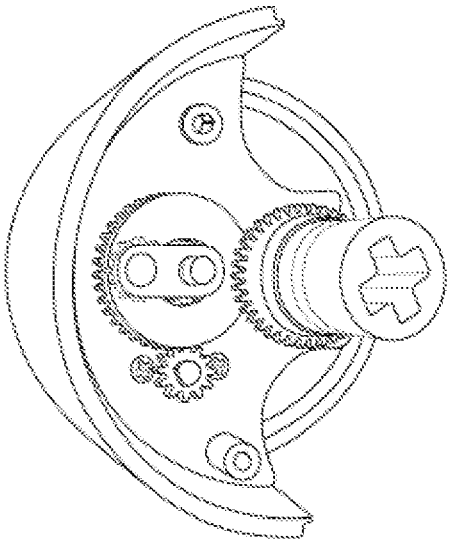
Figure 3C:
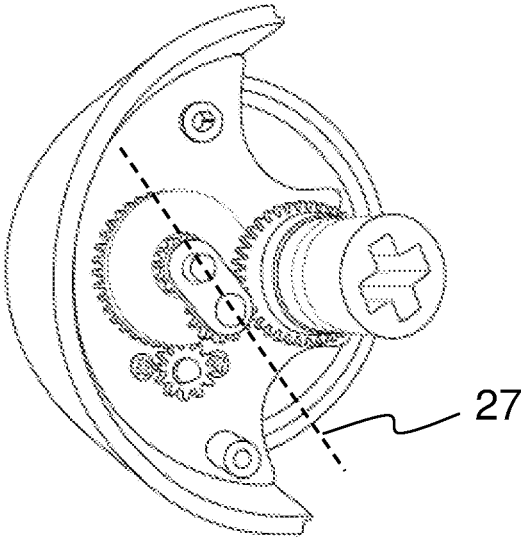
Figure 3D:
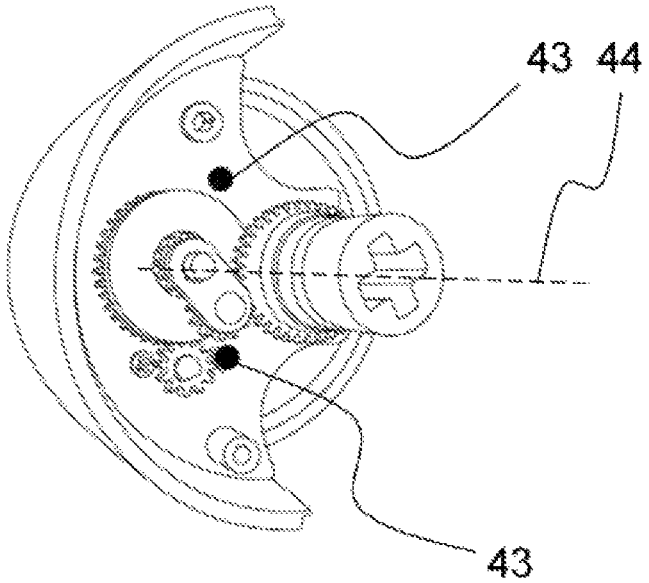
Figure 4:
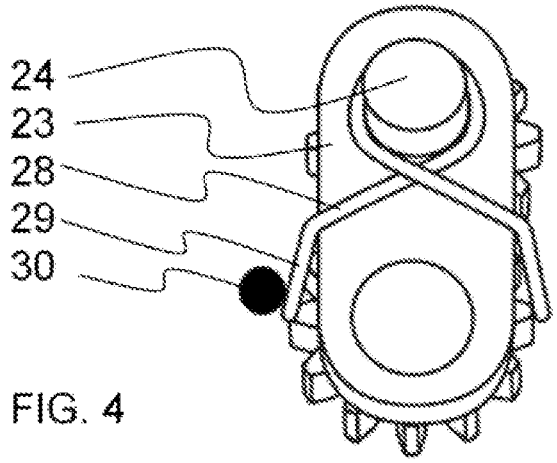
Figure 5A:
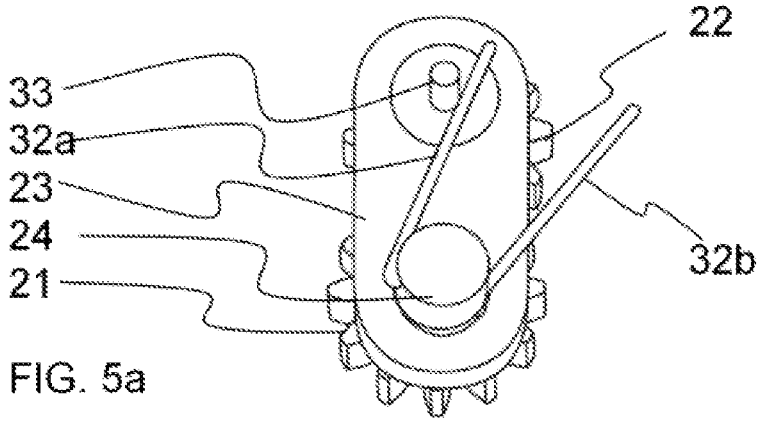
Figure 5B:
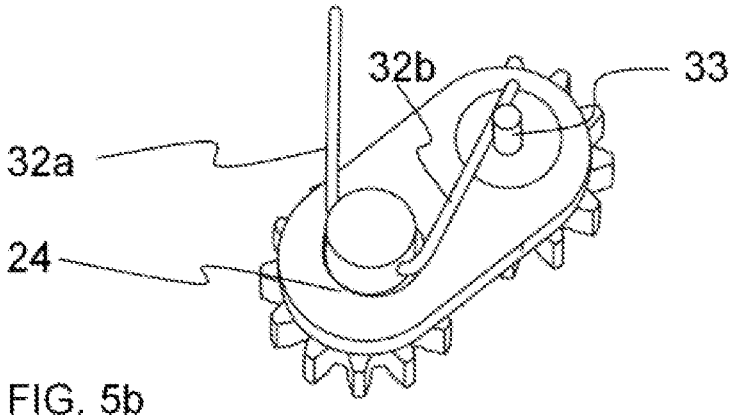
Figure 6A:
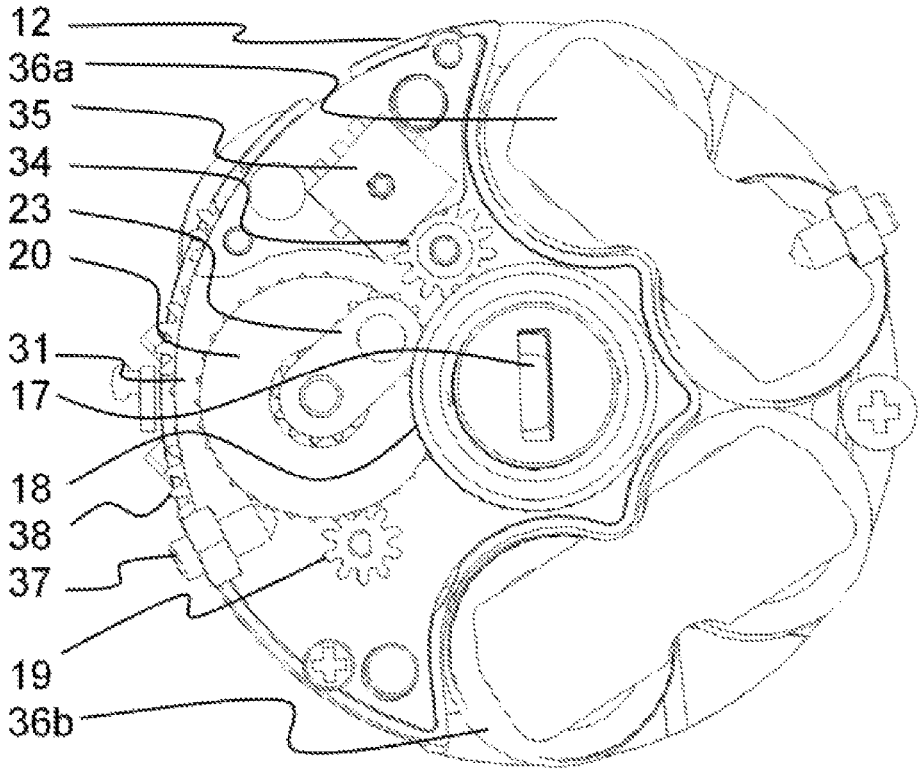
Figure 6B:
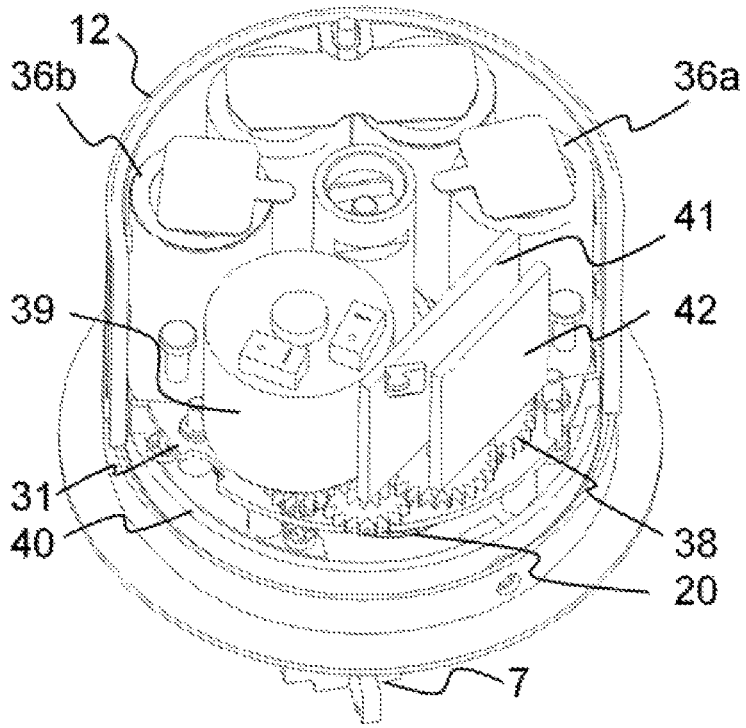

FIG. 3*a* illustrates the transmission gear system of the device in a first driving position of the gear, FIG. 3*b* illustrates the transmission gear system of the device in a neutral position, and FIG. 3*c* illustrates the transmission gear system of the device an opposite driving position of the gear, FIG. 3*d* illustrates the transmission gear system of the device with magnets for causing disengagement;

FIG. 4 illustrates a swingable bridge with a stationary spring member;

FIG. 5*a* illustrates a swingable bridge with a swingable spring member in a first position;

FIG. 5*b* illustrates a swingable bridge with a swingable spring member in a second position;

FIG. 6*a* is an illustration of a lock device with batteries and decoder;

FIG. 6*b* is an illustration of a perspective view thereof.

DETAILED DESCRIPTION

Figure 1:
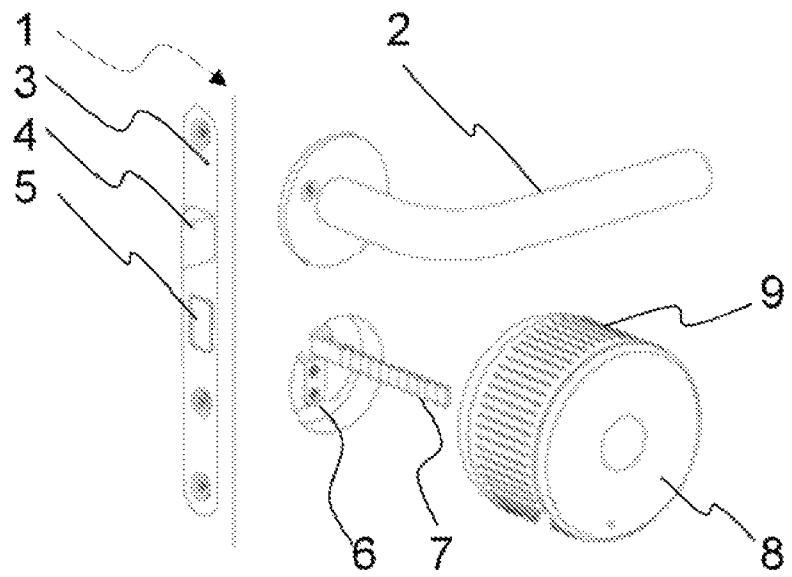
FIG. 1 prior art
FIG. 1 shows a known electromechanical door actuator system.

FIG. 1 illustrates a prior art door lock actuator system 8. A door blade 1 comprises a straight spring latch handle 2 that actuates a spring latch 4 in a door lock 3. A dead bolt 5 is actuated by a lock cylinder 6 that has a key receiver (not shown) on one side of the door blade 1. The lock cylinder 6 has on its opposite end towards the door blade a lock actuator pin 7 for connection to another lock element, for example a manual knob or an electrical actuator 8, as illustrated, which by rotation of the lock actuator pin 7 operates the dead bolt 5 between a fully retracted position, as illustrated, and a fully extended position, which is typically called a dead position. The electrical actuator is battery driven and also comprises a cylindrical handle 9 around the motorised electromechanical actuator 8. Turning the cylindrical handle 9 manually actuates the dead bolt 5 and also rotates the motor. In FIG. 1, the electromechanical actuator 8 is show as removed from the door, while it normally would be mounted onto the door blade 1 with the lock actuator pin 7 mounted inside the electromechanical actuator 8.

In the following, the electromechanical actuator system 8 of FIG. 1 is substituted by a different electromechanical lock device, however, the door 1 and the lock 3 with the lock actuator pin 7 serve as an equal basis and are referred to in similar manner.

Figure 2:
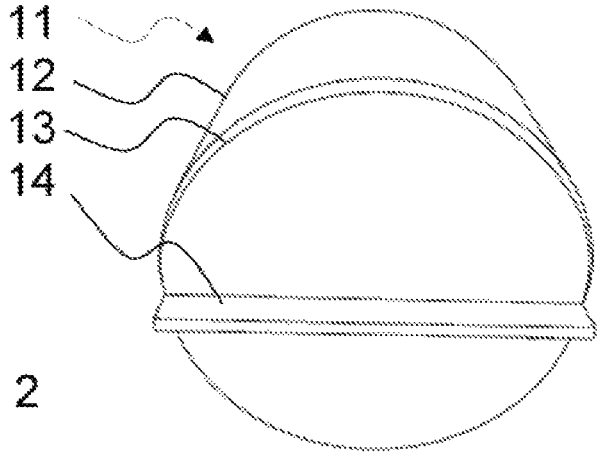
FIG. 2 illustrates a first part of a device with a handle.

FIG. 2 illustrates a lock device 11 with a cylindrical casing 12 at which one end there is provided a manually rotational handle 13 comprising a circular plate 14 and an outwards protruding profile 15 across the plate 14 for easy grabbing and rotating of the handle 13, functioning as a thumbturn. The cylindrical casing 12 is configured for mounting onto a door blade similarly to the actuator system in FIG. 1 such that it received the lock actuator pin 7 into the opposite end of the casing 12 relatively to the end with the handle 13.

FIG. 3*a* illustrates a gearing system 10 of the lock device 11 as seen in a partially cut out illustration opposite to the handle 13. The handle 13 is fastened to a connector-receiver 16, which due to the connector being a lock actuator pin, in the following is called a pin-receiver 16, although it may be easily modified to receive a different type of connector that is connected to the dead bolt 5 for driving it by rotation of the connector.

Rotation of the handle 13 rotates the pin-receiver 16. The pin-receiver 16 received the lock actuator pin 7 in the slot 17, and when rotated by the handle 13, rotated the lock actuator pin 7 and consequently moves the dead bolt 5. The pin-receiver 16 comprises a receiver-gearwheel 18 which rotates together with the pin-receiver 16. This receiver-gearwheel 18 is used for driving the pin-receiver 16 by a motor through the gearing system 10. An electrical motor located underneath a first cover plate 31 is driving a first gearwheel 19 which is intermeshed with a second gearwheel 20. On the second gearwheel 20, a third gearwheel 21 is solidly fixed such that it rotates together with the second gearwheel 20 around a stationary axle 24. A bridge 23 is rotationally mounted on the stationary axle 24. This bridge 23 carries an axle 26 for a fourth gearwheel 22, which intermeshes with the third gearwheel 21 such that rotation of the third gear 21 wheel causes rotation of the fourth gearwheel 22 in the opposite direction. The bridge 23 is connected to the third gearwheel 21 through a friction clutch 25. When the third gearwheel 21 rotates, the friction clutch 25 creates sufficient friction between the third gearwheel 21 and the bridge 23 to swing the bridge 23 by the rotating third gearwheel 21, unless there is an obstacle that prevents the swinging of the bridge 23, in which case the friction clutch 25 breaks the connection between the third gearwheel and the bridge 23 in order to allow the third gearwheel 21 to continue its rotation without further swinging of the bridge 23.

The electro-mechanical and manual operation of the lock is as follows. In the state of the gearing system 10 as illustrated in FIG. 3*b*, the fourth gearwheel 22 is in a position remote from the receiver-gearwheel 18, allowing free manual operation of the pin-receiver 16 without engaging with the first, second, third and fourth gearwheels 19-22. When the motor is activated in a first direction, the first gearwheel 19 drives the second gearwheel 20, by which the third gearwheel 21 is rotating, by which the bridge 23 is swinging towards the pin receiver gearwheel 18, until the teeth of the fourth gearwheel 22 intermesh with the teeth of the receiver-gearwheel 18. This situation is illustrated in FIG. 3*a*. The receiver-gearwheel is an obstacle for further swinging of the bridge 23, and the swinging will stop, while the third gearwheel continues rotating due to the friction clutch 25 between the third gearwheel 21 and the bridge 23. The continuous rotation of the third gearwheel 21 puts rotational force on the now stationary bridge 23 and presses the fourth gearwheel 22 against the receiver-gearwheel 18 at a first angular position. The rotation of the third gearwheel 21 drives the fourth gearwheel 24 which in turn drives the receiver-gearwheel. This way, the pin-receiver 16 is rotated in a first direction, which actuates the lock actuator pin 7 in the pin-receiver 16 and, accordingly, moves the dead bolt 5.

When the dead bolt has moves to the end position, the motor is stopped. For example, the dead bolt is driven until it meets a hardware stop, which makes further driving of the dead bolt by the motor impossible, increasing the power consumption of the motor, which is measured electronically and the motion of the motor stopped in this direction. Alternatively, an angular motion decoder is used which controls the angular maximum rotation of the pin-receiver 16 and stops the motor prior to the dead bolt 5 reaching a hardware stop.

When the dead bolt 5 is to be moved in the opposite direction, the motor direction is reversed, and the first, second and third gearwheels 19-21 are rotated in an opposite direction. The bridge 23 is swung in the opposite direction together with the rotation of the third gearwheel 21, until the fourth gearwheel 24 abuts the receiver-gearwheel 18 and intermeshes with the teeth at a second angular position on the opposite side of the receiver-gearwheel as compared to the situation in FIG. 3*a*. This situation is illustrated in FIG. 3*c* as compared to FIG. 3*a*. The continuous driving of the third gearwheel 21 due to the friction clutch 25 between the third gearwheel 21 and the bridge 23 presses the teeth of the fourth gearwheel 22 into the teeth of the receiver-gearwheel 18.

The switch between the first and second angular position is made very quickly as compared to the actuation of the connector, especially, if the swingable fourth gearwheel 22 is smaller than the receiver-gearwheel 18.

For minimal lateral force from the fourth gearwheel on the bridge 23, the axle 24 of the third gearwheel 21 and the axle 26 of the fourth gearwheel 22 are on a centre line 27 that is tangential to the receiver-gearwheel 18.

In order for the manual operation being possible without turning the motor, the bridge 23 is rotated away from the pin-receiver such that the fourth gearwheel 22 does not any longer engage with the receiver-gearwheel 18 after electro-mechanical actuation.

For example, at the end of the electromechanical actuation, the motor is reversed and the bridge 23 swung away into the position as illustrated in FIG. 3*b*. Alternatively, the bridge 23 is only rotated a small angular distance from the pin-receiver 16 such that the teeth of the fourth gearwheel 22 are just free of the teeth of the receiver-gearwheel 18.

As an alternative to the reversing of the motor, a magnet system with one or more magnets is provided and used for disengaging the fourth gearwheel 22 on the bridge 23 from the receiver-gearwheel 18.

An example of such a system is illustrated in FIG. 3*d*. Two magnets 43 are arranged on opposite sides of a line 44 connecting the centre of the receiver-gearwheel 18 with the centre of the non-rotational axle 24 for the third gearwheel 21. The bridge 23 with the swingable fourth gearwheel 22 is provided with metal or magnet that is attracted to the magnets 43. Activation of one of the magnets 43 causes the bridge 23 to be swung away from an orientation such that the fourth gearwheel 22 disengages with the receiver-gearwheel 18. Either of the magnets 43 is used for the corresponding side on which the fourth gearwheel 22 engages with the receiver-gearwheel 18.

As further alternative, the receiver-gearwheel 18 or the pin receiver is provided with a magnet repelling the bridge 23 in order to cause disengagement.

For example, the magnets are electromagnets that are electrically activated in order to create a magnetic force upon activation, which causes disengaging of fourth gearwheel 22 from the receiver-gearwheel 18.

Alternatively, the magnets are permanent magnet that exerts force on the bridge 23 against the force from the friction clutch 25. As long as the motor is active and through the friction clutch 25 presses the fourth gearwheel 22 into engagement with the receiver-gearwheel 18, the force of the magnet is not strong enough to disengage the fourth gearwheel 22 from the receiver-gearwheel 18. The friction clutch and the magnet are adjusted such that the force on the bridge 23 from the friction clutch 25 is higher than the counteracting force from the magnet. However, once the motor stops, the magnetic force is strong enough to cause a minute displacement, sufficient for disengagement of the fourth gearwheel 22 from the receiver-gearwheel 18.

A further alternative is provided with spring force acting against the bridge in a direction away from the pin-receiver. When the bridge 23 is driven and pressed against the receiver-gearwheel 18 by the third gearwheel 22 through the friction clutch 25, the force due to the friction clutch is use to also deform a spring member. Once the force is stopped due to stopping of the motor, the spring member presses the bridge 25 away from the pin-receiver 16 without rotating the third gearwheel 23, which is possible due to the friction clutch between the third gearwheel 21 and the bridge 23. Examples of such spring arrangements are illustrate in FIGS. 4 and 5.

In the example of FIG. 4, the bridge 23 is provided with a spring member 28 that extends around the axle 24 and is fastened to the axle 24. The spring member 28 has a resilient part 29 on either side for abutment against an abutment pin 30. For example, with reference to FIG. 3*a*, the abutment pin of FIG. 4 extends from a fastening point on the first cover plate 31. Alternatively, a second cover plate (not shown in FIGS. 3 and 4) is provided on top of the gearing system 10, which is on the opposite side as compared to the first cover plate 31 relatively to the gearing system 10, and the abutment pin 30 extends from such second cover plate.

When the bridge 23 is swung for intermeshing the teeth of the receiver-gearwheel 18 and the fourth gearwheel 22, the resilient part 29 of the spring member 28 abuts the abutment pin 30 and is resiliently deformed against the abutment pin 30 due to the pressing force of the bridge 23 towards the receiver-gearwheel 18. While the third gearwheel 21 is rotating, the friction clutch 25 provides force enough to deform the resilient part 29 of the spring member 28 and to keep the fourth gearwheel 22 in tooth-engagement with the receiver-gearwheel 18. Once, the rotation stops, the force on the resilient part 29 stops as well, and the resilient part 29 returns to the original shape, pressing the bridge 23 away from the abutment pin 30 and, thereby, the fourth gear 22 wheel away from the receiver-gearwheel 18 and out of the engagement with the receiver-gearwheel 18.

An alternative configuration is illustrated in FIGS. 5*a* and 5*b* in perspectives as seen from different angles. In this case, a first and second resilient spring rod 32*a*, 32*b* is fastened to the non-rotational axle 24, and the bridge 23 is provided with a protrusion 33 that engages with and deforms the first or the second resilient spring rod 32*a*, 32*b*, dependent on the rotational direction, as illustrated in FIG. 5*b* relatively to FIG. 5*a*. Other configurations are possible to achieve a similar effect as explained in connection with FIG. 4 and as shown in FIG. 5. The deformation of the first resilient rod 32*a* occurs when the bridge 23 is rotated clockwise by the friction clutch 25, and the abutment pin 30 is deforming the first resilient rod towards the receiver gearwheel 18. Once, the rotation stops, the first resilient rod 32*a* flexes back into the relaxed state and presses the bridge 23 counter-clockwise such that the fourth gearwheel 22 slips out of engagement with the receiver-gearwheel 18. Correspondingly, the second resilient rod 32*b*, as illustrated in FIG. 5*b*, presses the bridge 2 back in the opposite direction after stop of rotation, due to the back-flexing.

FIGS. 6*a* and 6*b* illustrate further details of the lock device. FIG. 6*a* shows a head-on view onto the pin receiver 16. In this embodiment, the slot 17 for the actuator pin 7 is different from the embodiment in FIG. 3. As illustrated in FIGS. 6*a* and 6*b*, the device comprises four batteries 36 for powering the motor 39 of the actuator. Between the first gearwheel 19 and the motor 39, which are on opposite sides of the first cover plate 31, there are provided further gearwheels 38. The lock device comprises fixing screws 37 for fixing the casing 12 on a mounting plate against the blade of the door 1. The teeth of a toothed decoder wheel 34 intermesh with the teeth of the receiver-gearwheel 18 and translate the rotation of the receiver-gearwheel 18 to digital data in an electronic decoder 35 in order to continuously measure and control the angular position of the receiver-gearwheel 18. This decoder 35 is in electronic connection with the motor 39 and configured to stop the motor 39 at a predetermined position of the receiver-gearwheel 18, for example shortly before hardware stop of the dead bolt 5. In some embodiments, the decoder 35 is used to cause back-turning the motor 39 after each stop in order to disengage the fourth gearwheel 22 from the receiver-gearwheel 18, as explained above.

Optionally, the decoder 35 is used to activate the motor 39 when a manual turning of the handle 13 is detected via the manually rotated connector receiver 16 and the decoder wheel 34.

The device comprises a printed circuit board 41 with a transceiver 42 inside the casing for controlling wireless data transfer and for executing wireless digital command data for locking or unlocking the door lock, the printed circuit board 41 being functionally coupled to the motor 39 for activating the motor 39 in dependence of the locking or unlocking command.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

REFERENCE NUMBERS

1 door blade
2 spring latch handle
3 door lock
4 spring latch
5 dead bolt
6 lock cylinder
7 lock actuator pin (spindle pin)
8 electrical actuator
9 cylindrical handle
10 gearing system to drive the pin-receiver 16
11 door lock actuation device
12 cylindrical casing
13 manually rotational handle
14 circular plate of handle 13
15 outwards protruding profile across plate 14
16 pin-receiver
17 slot for lock actuator pin 7 in pin-receiver 16
18 receiver-gearwheel
19 first gearwheel
20 second gearwheel, tooth-engaged with first driver gearwheel 19
21 third gearwheel solidly connected and co-axial with second gearwheel 20
22 fourth gearwheel tooth-engaged with third gearwheel 21
23 bridge connecting third gearwheel 21 and fourth gearwheel 22
24 non-rotational axle for third gearwheel 21
25 friction clutch between third gearwheel 21 and bridge 24
26 axle for fourth gearwheel 22
27 centre line from centre of axle 24 and axle 26
28 spring member
29 resilient part of spring member for abutment to abutment 30
30 abutment pin
31 first cover plate
32*a*, 32*b* first and second resilient spring rod
33 protrusion on bridge 23
34 decoder wheel
35 electronic decoder
36 batteries
37 fixing screws
38 further gearwheels
39 motor
40 second cover plate
41 printed circuit board
42 transceiver
43 magnets
44 line from the centre of the receiver-gearwheel 18 to the centre of the non-rotational axle 24 for the third gearwheel 21

The invention claimed is:

1. A door lock actuation device for operating a door lock in a door blade, wherein the door lock comprises a dead bolt driven by rotation of a connector that is functionally connected to the dead bolt; the device comprising a casing, inside which there is provided a rotational connector-receiver for receiving and rotating the connector when the casing is mounted on the door blade; wherein a motor is provided inside the casing for driving the connector-receiver; the device comprising a rotational handle mechanically connected to the connector-receiver for forcing rotation of the connector-receiver by manual rotation of the handle; the connector-receiver comprising a receiver-gearwheel such that rotation of the receiver-gearwheel in opposite directions causes rotation of the connector-receiver in opposite directions; the device comprising a first gearwheel that is coupled to the motor for being driven by torque from the motor, the first gearwheel being connectable to the receiver-gearwheel by intermeshing for conveying torque from the motor to the receiver-gearwheel via the first gearwheel, characterised in that the first gearwheel is disconnectable from the receiver-gearwheel for breaking the intermeshing torque connection between the receiver-gearwheel and the motor, thereby providing selective motorised or manual driving of the connector-receiver, wherein the intermeshing between the first gearwheel and the receiver-gearwheel is provided by a gearwheel system with a plurality of gearwheels comprising teeth in intermeshing configuration, wherein the gearwheel system comprises a bridge extending from a stationary gearwheel axle to a swingable gearwheel axle, the stationary gearwheel axle being in rotational connection with a stationary motor-driven gearwheel and the swingable gearwheel axle being in rotational connection with a swingable gearwheel, wherein the two gearwheels are intermeshed; the swingable gearwheel axle being carried by the bridge; wherein the bridge is arranged swingable between a first angular position and a second angular position by rotation of the bridge about the stationary gearwheel axle, wherein the first angular position of the bridge provides an intermeshing of the swingable gearwheel with the receiver-gearwheel at one location of the receiver-gearwheel for driving the receiver-gearwheel in a first rotational direction by the swingable gearwheel, and wherein the second angular position of the bridge the swingable gearwheel provides an intermeshing with the receiver-gearwheel at another location of the receiver-gearwheel for driving the receiver-gearwheel in a second, opposite rotational direction by the swingable gearwheel, wherein the door lock actuation device further comprises an electronic decoder configured for measuring the angular movement of the connector-receiver, and being configured for stopping the motor and the rotation of the connector-receiver at a predetermined dead bolt extension position and retraction position, wherein the decoder is at least one of A and B, wherein in A, the electronic decoder is functionally connected to a toothed decoder wheel intermeshed with the gearwheel system or with the receiver-gearwheel, the rotation of the decoder wheel being readable by the decoder; and wherein in B, the electronic decoder is configured for reversing the motor as a consequence of stopping the motor for driving of the first gearwheel in an opposite direction less than the angular distance between the first and the second angular position for disconnecting the motor from the connector-receiver by separating the bridge from the receiver-gearwheel, for allowing unhindered manual rotation of the connector-receiver while disconnected from the motor.

2. A door lock actuation device according to claim 1, wherein the bridge is connected to the stationary rotational gearwheel through a friction clutch for swinging the bridge by rotation of the stationary motor-driven gearwheel, unless the rotation of the bridge is blocked by the instance of the swingable gearwheel abutting the receiver-gearwheel at the first or the second rotational position, in which case the friction clutch allows frictional rotational movement between the stationary rotational gearwheel and the bridge.

3. A door lock actuation device according to claim 1, wherein the bridge is configured for rotation over a range of more than 180 degrees between the first and second angular position.

4. A door lock actuation device according to claim 1, wherein the rotation of the bridge from the first to the second position is caused by rotation of the motor in one direction, and the rotation of the bridge from the second to the first position is caused by rotation of the motor in the opposite direction.

5. A door lock actuation device according to claim 1, wherein a magnet system is provided and arranged for providing magnetic force acting on the bridge for disengaging the swingable gearwheel from the intermeshing with the receiver-gearwheel.

6. A door lock actuation device according to claim 5, wherein the magnet system comprises at least one electromagnet configured for electrical activation to provide the magnetic force acting on the bridge.

7. A door lock actuation device according to claim 1, wherein a resilient spring mechanism provided at the first and at the second position, the spring mechanism being configured for acting against the force of the bridge against the receiver-gearwheel for separating the swingable gearwheel from engagement with the receiver-gearwheel.

8. A door lock actuation device according to claim 1, wherein the device comprises a receiver for receiving and executing wireless digital command data for locking or unlocking the door lock, the receiver being functionally coupled to the motor for activating the motor in dependence of the locking or unlocking command.

* * * * *